United States Patent [19]

Eicher

[11] Patent Number: 4,943,174

[45] Date of Patent: Jul. 24, 1990

[54] ARRANGEMENT FOR POSITION INDICATION OF AN EDGE OF A SHEET-SHAPED DATA CARRIER

[75] Inventor: Helmut M. Eicher, Wenden, Fed. Rep. of Germany

[73] Assignee: U.S. Philips Corporation, New York, N.Y.

[21] Appl. No.: 349,729

[22] Filed: May 10, 1989

[30] Foreign Application Priority Data

May 13, 1988 [DE] Fed. Rep. of Germany ..... 3816367

[51] Int. Cl.[5] ..... B41J 29/42; B41J 29/46

[52] U.S. Cl. ..... 400/703; 400/708

[58] Field of Search ..... 400/703, 708, 706; 271/258

[56] References Cited

U.S. PATENT DOCUMENTS 3,888,478 6/1975 Alderman, Jr. et al. ..... 271/258 X
3,924,848 12/1975 Murakami ..... 271/258 X
4,354,766 10/1982 Hendrischk et al. ..... 400/708
4,579,056 4/1986 McGourty et al. ..... 400/157.1 X
4,793,605 12/1988 Tajima ..... 400/708 X

*Primary Examiner*—Edgar S. Burr
*Assistant Examiner*—M. Patel
*Attorney, Agent, or Firm*—William Squire

[57] ABSTRACT

A lever projects into the space between two guide plates for a sheet data carrier and is journalled so as to upwardly pivotable in the transport direction of the carrier against the force of a spring. A Hall-element sensor is secured adjacent to a magnet secured to the journalled end of the lever so that the sensor is activated by translation or rotation of the lever effected by engagement of the lever with the feeding of the data carrier. The lever is arranged to initially translate to activate the sensor and rotated after the translation so that when the lever is returned to its position prior to translation, only rotation of the lever switches the state of the sensor to indicate the position of the trailing edge of the carrier.

15 Claims, 3 Drawing Sheets

ARRANGEMENT FOR POSITION INDICATION OF AN EDGE OF A SHEET-SHAPED DATA CARRIER

The invention relates to an arrangement for position indication of an edge of a sheet-shaped data carrier, which is transported between two guide plates of a printing apparatus.

An arrangement of the kind mentioned in the opening paragraph is known, for example, from German patent application No. 3535964. The known construction has a catching device for data carriers to be pulled into a book-keeping machine. This arrangement has a feeding support for the data carriers and sensing levers which are arranged in a line perpendicular to the pulling-in direction and recognize the alignment position of the front edge of an inserted data carrier. In the end abutment position of the sensing arms, indicator switches are actuated through actuation arms, the pulling-in operation being initiated when these switches are actuated at the same time. In the first instance the object is to control sufficiently accurately the pulling-in position of the data carrier of different widths. For this purpose, an inner sensing lever, a central sensing lever and an outer sensing lever are provided, which cooperate in a given manner with associated indicator switches. A construction having such a mechanical scanning yields a comparatively large switching hysteresis, a comparatively large amount of adjustment labour and occupies a comparatively large amount of space.

The invention has for its object to improve an arrangement of the kind mentioned in the opening paragraph with a view to the said disadvantages and to increase the indication accuracy. This object is achieved in that a lever, which projects into the space between the guide plates and is journalled so as to be upwardly pivotable in the transport direction of the data carrier against the force of a lever spring, and a fixedly arranged sensor are provided, and in that the sensor and the bearing end of the lever are arranged with respect to each other and are tuned to each other so that the sensor can be activated upon a movement of the lever effected by feeding of the data carrier. The use of such a lever, whose bearing end acts upon a sensor in the sense of an activation as soon as the lever is moved by feeding of the data carrier, permits in a simple manner not very sensitive to disturbance an accurate recognition of the edge of the data carrier transported in the transport direction between the guide plates. The activation of the sensor is effected upon the first movement of the pivot end of the lever because this pivot end is located in the direct operating range of the sensor. The sensor may be, for example, a Hall-element, which is located in the operating range of a permanent magnet arranged at the pivot end of the lever, the Hall-element being located in the operating range of the magnetic field only in the rest position of the arrangement when the lever is bent rectangularly with respect to the guide plates. The activation of the sensor is effected as soon as the pivot end is moved with respect to the sensor. This movement can be either a rotary movement of the lever or a parallel movement taking place in the transport direction.

In a first embodiment, the lever can be journalled rotatably so as to be stationary with respect to the data carrier passed between the guide plates. The lever may be arranged, for example, so as to be pivotable in a housing secured on the upper guide plate, the said housing also accommodating the sensor. As soon as in this arrangement the edge of the data carrier, for example of a single sheet of paper or of a set of forms, touches the lever, the latter is upwardly pivoted so that the paper slides along under the lever. The sensor has then been activated by the rotary movement of the pivot end of the lever. This construction is dependent upon the thickness of the data carrier. With thick data carriers, for example with a set of forms, the sensor is activated more rapidly than with a thin single sheet because for the same rotary movement of the lever the single sheet must cover a larger path in the transport direction than the set of forms.

A complete independence of the thickness of the data carrier can be achieved in a preferred embodiment of the invention in that the lever is journalled on a carriage passed in the transport direction against the force of a carriage spring between two abutment stops, and in that the lever spring and the carriage spring are dimensioned so that the lever is displaced upon the movement of the carriage to the end abutment and is pivoted upwards when the end position of the carriage is reached and is pulled back with the carriage by the carriage spring into the starting position. Upon the first contact between the data carrier and the lever, the lever is not pivoted upwards, but is moved in the transport direction together with the carriage. This movement is therefore independent of the thickness of the data carrier. As soon as the carriage has reached its end abutment, the lever is pivoted upwards so that the data carrier is passed along under the lever pivoted upwards. At the same time, the carriage with the upwardly pivoted lever is pulled back into the starting direction opposite to the transport direction. The independence of the thickness of the data carrier is therefore achieved by the mechanical decoupling of the two movements successively initiated by the passing data carrier. A simple construction and a positioning not very sensitive to disturbance of the lever is obtained, for example, in that the latter is hinged to the upper side of the carriage by a hinge.

In the drawing, FIGS. 1 to 7 show embodiments of an arrangement according to the invention, a carriage movable in the transport direction and a lever pivotably arranged on the said carriage being provided.

Figure 1:
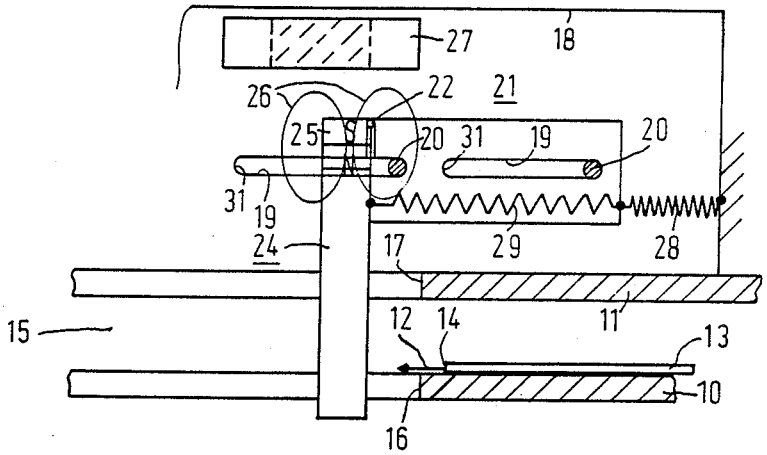
FIG. 1 shows the rest position in accordance with one embodiment of the present invention.

The arrangement shown in the Figures has a lower guide plate 10 and an upper guide plate 11, between which a data carrier 13 is passed in the transport direction 12. The data carrier 13 may be, for example, a single sheet or a set of forms consisting of several sheets. The front edge of the data carrier 13 is denoted by reference numeral 14. Both guide plates 10 and 11 have between them a space 15 and are provided with a respective recess 16, 17. On the upper guide plate 11 is secured a housing 18, which elongated is provided with guide slots 19. A carriage 21 longitudinally displaceable in the transport direction 12 slides over pins 20 located in slots 19. The carriage 21 carries at its front side a lever 24, which is pivotably journalled through a hinge 22 in the direction 23. Lever 24 projects in the rest position shown in FIG. 1 rectangularly to the transport direction 12 into the two recesses 16 and 17 of the guide plates 10 and 11. The bearing hinged end of the lever 24 carries a permanent magnet 25 having a magnetic field 26. A stationary Hall-element 27, which is in the form of a sensor, is located in the rest position shown in FIG. 1 in the operating range of the magnetic field 26. The carriage 21 is pre-stressed by a carriage spring 28 and the lever 24 is pre-stressed by a lever spring 29. The prestress of the lever spring 29 is higher than that of the carriage spring 28 available for pulling back the carriage 21. The guide slots 19 form abutment stops 30 in the rest position and abutment stops 31 in the end position—viewed in the transport direction 12—of the carriage 21.

Figure 2:
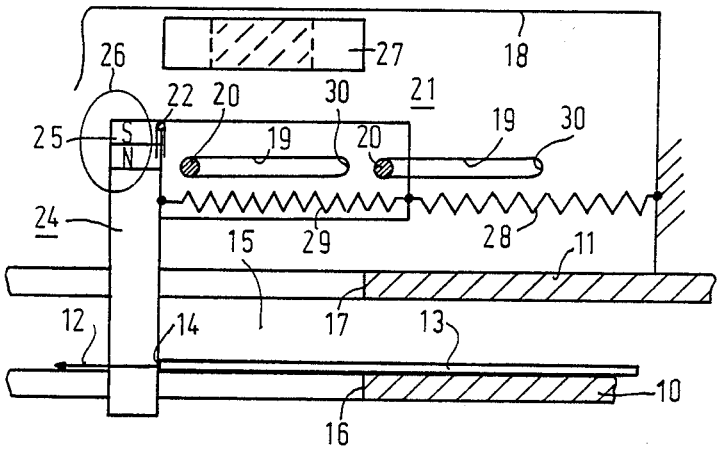
FIG. 2 shows a position after a first movement has taken place from the position of FIG. 1.
Figure 3:
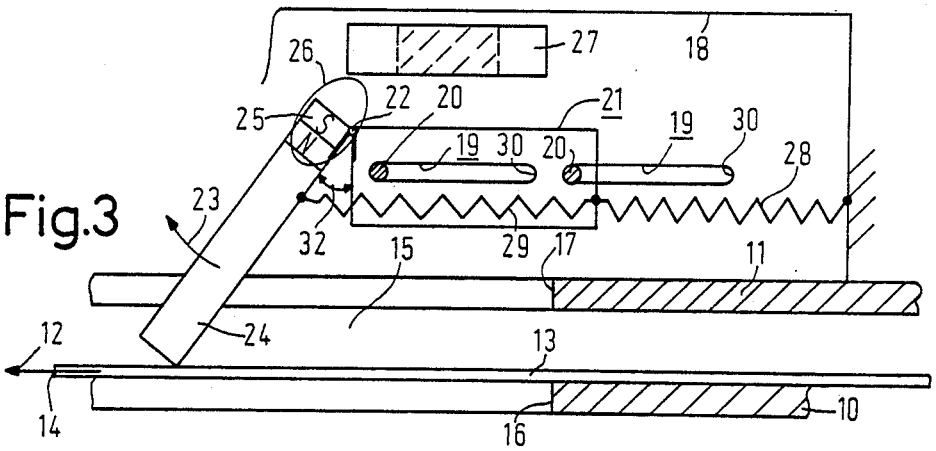
FIG. 3 shows the arrangement with upwardly pivoted lever.
Figure 4:
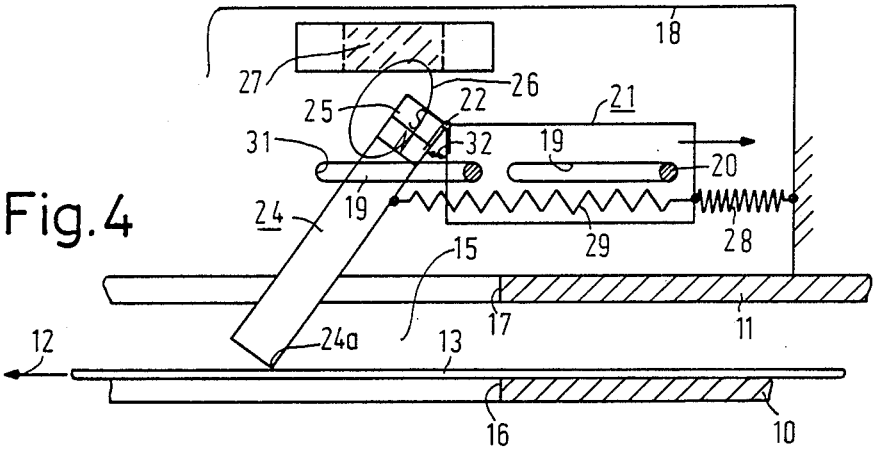
FIG. 4 shows the arrangement with the carriage pulled back into the rest position, but with the still inserted data carrier and the upwardly pivoted lever.

In the rest position shown in FIG. 1, the magnet 25 is arranged perpendicularly below the Hall-element 27, which is switched only in this magnet position. The carriage 21 and the lever 24 are pulled by the springs 28, 29 against their respective abutment stops. According to FIG. 2, the carriage 21 has reached its end position, the pins 20 abutting against the stops 31 of the carriage guides 19. This position is attained in that the front edge 14 of the data carrier 13 abuts against the lever 24 and takes along the carriage 21 and the lever 24 in synchronism with the feeding of the front edge of the data carrier 13. Because of the higher prestress of the lever spring 29, the lever 24 is not opened. With the first movement of the carriage, the switching magnet 25 moves out of the operating range of the Hall-element 27, which is switched off in a defined position independently of the thickness of the data carrier 13. After the carriage 21 according to FIG. 2 has reached its end position, to the left in the drawing Figure the lever 24 is pivotally displaced by the data carrier 13 moved further in the direction 12. Also the switching magnet 25 is then brought into an oblique position (cf. FIG. 3). The lever 24 lifted by the upward pivoting is held no longer by the front edge 14 of the carrier 13 so that the carriage spring 28 pulls the carriage 21 with the displaced lever 24 back to the abutment stops 30 to the right in the drawing FIG. 4. Since due to the oblique position of the lever, the switching magnet 25 is also rotated. In this oblique position, the Hall-element 27 is not switched on (cf. FIG. 4), as a result of which, the presence of a data carrier is continuously indicated. The upwardly pivoted lever 24 is located with an edge **24*a* on the data carrier 13 as long as the latter is present. The angle then enclosed by the upwardly pivoted lever 24 must be so large that the magnetic field 26 of the obliquely arranged magnet 25 cannot lead to the Hall-element 27 being switched on. For this purpose, the lever 24 projecting in the rest position into the intermediate space 15, i.e. into the two recesses 16, 17 of the guide plates 10, 11**, must have a sufficient length.

Figure 5:
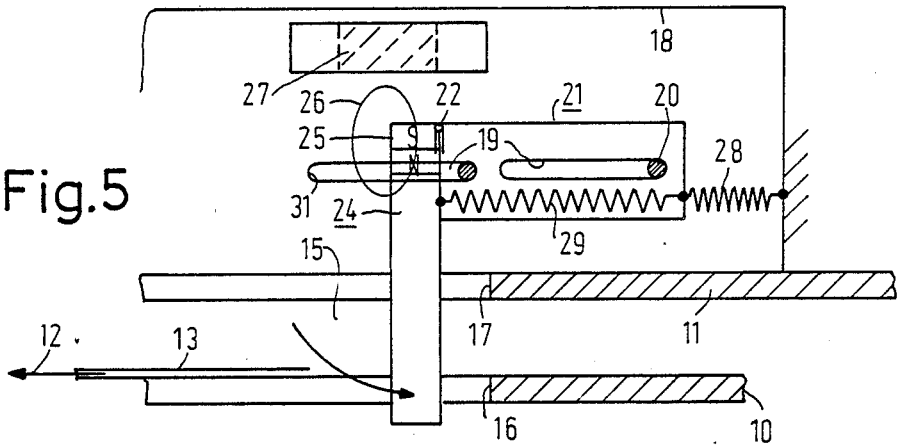
FIG. 5 shows the arrangement shown in FIG. 4 without a data carrier and with the lever pivoted backwards.

After the data carrier 13 shown in FIG. 5 has passed, the lever 24 abruptly drops, accelerated by the pulling force of the lever spring 29, and thus returns the switching magnet 25 to the position at right angles to the Hall-element 27. The Hall-element 27 is switched on without chatter because mechanical chatter no longer can switch off the Hall-element 27 when the lever 24 abuts against the carriage 21, because of the excessively small angle variation.

Figure 6:
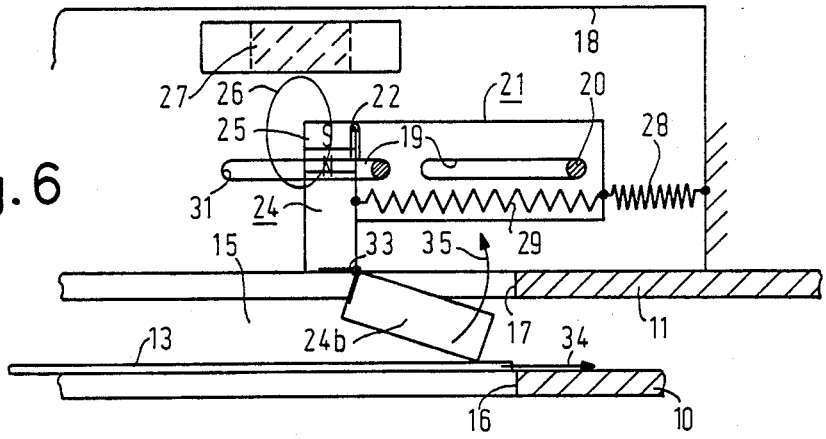
FIG. 6 shows a construction having a differently constructed lever.

FIG. 6 shows a variation of FIGS. 1 to 5, according to which the lever 24 is provided with an elbow hinge 33 to which is secured lever end **24*b*. Upon a backward movement of the data carrier 13 in the direction 34 the paper track is not blocked and the backward movement cannot initiate a switching function. With such a backward movement, the end 24*b* of lever 24 is rotated in the direction 35**.

Figure 7:
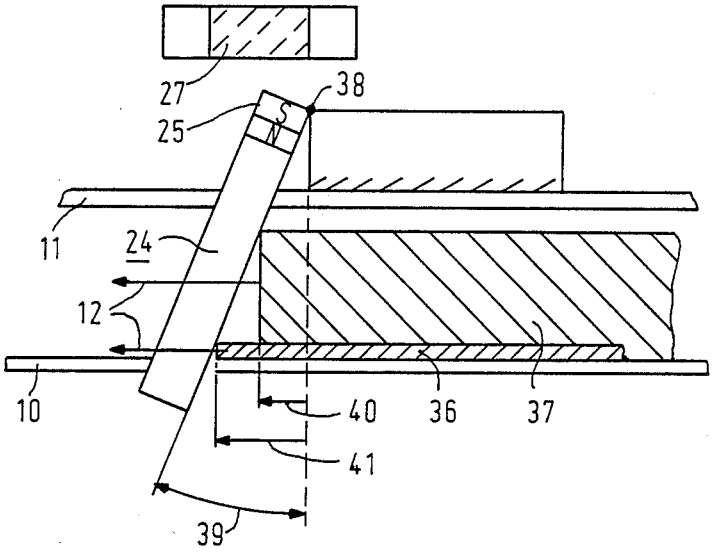
FIG. 7 shows diagrammatically the difference in deflection of the lever with a thin and a thick data carrier.

FIG. 7 shows diagrammatically the effects of a thin and of a thick data carrier 36, 37, respectively on the position of the lever 24 and hence on the switching instant of the Hall-element 27. It is assumed that the lever 24 is journalled in the rotary point 38 fixedly with respect to the data carriers 36, 37 to be transported. It can be seen that, in order to attain the same rotary angle 39, the thick carrier 37 requires a short track 40 and the thin single sheet 36 requires a longer track 41. If, however, the lever 24 is journalled not fixedly, but, as shown in FIGS. 1 to 6, on the carriage 21 movable in the transport direction, such a dependence upon the paper thickness no longer occurs.

The construction according to the invention permits a simple and accurate adjustment. With a given movement of the lever (either as rotary movement with a fixed journalling or as parallel movement with journalling on a carriage), the sensor 27 is activated, as a result of which, for example, a switching operation is initiated. With the same apparatus, this activation always takes place with the same movement of the lever. After the activation of the sensor 27, when the data carrier 13 is further transported, the steps are counted by which the data carrier must be transported further until it reaches the first printing position.

The high reproducibility of the switching point and the independence of the state of the data carrier (for example transparent foil) and further the independence of the thickness of the data carrier 13 in the construction with the lever 24 hinged to the movable carriage 21 are important. The switching point depends in each apparatus upon several different factors, for example upon the respective spatial association between the sensor element 27 and the bearing end of the lever 24 or upon the field strength of the magnet 25. For each individual apparatus, the switching instant is always constant, however. The transport path from the switching instant to the first printing position is also subjected to tolerances, for example by the position of stamping-out for the housing 18 in the upper guide plate 11. In order to obtain the exact paper track (countable in steps of a driving stepping motor) from the switching instant to the first printing position, the latter is counted out individually as the number of transport steps for each apparatus (for example printer) and is stored as a constant in a printer program. By such a process, a whole chain of tolerances is eliminated.

What is claimed is:

1. An arrangement for position indication of an edge of a sheet-shaped data carrier, which is transportable in a transport direction in the space between two guide plates of a printing apparatus, said arrangement comprising:

a lever having a bearing end and means pivotally journalling said bearing end for rotation generally in said transport direction;

a lever spring secured to the lever for opposing said rotation;

a sensor fixedly secured relative to the lever, said sensor and lever being arranged and aligned relative to one another such that the sensor is activated upon movement of the lever in response to the transport of the data carrier in said space;

a carriage moveable parallel to the transport direction between start and end stop positions; and a carriage spring for opposing the displacement of the carriage in the transport direction;

said springs being so dimensioned such that the lever in response to engagement with the data carrier is displaced with the carriage in the transport direction to said end stop position and then pivoted after the carriage reaches said end stop position, said lever and carriage being returned to the start position after said lever pivots.

2. Apparatus for position indicating a leading edge of sheet material moving in a path in a given direction with a rotatable lever, said lever tending to rotate through different angular extents in response to said moving edge in accordance with the thickness of said material, said apparatus comprising:

a carriage secured for displacement in said given direction;

a lever having a bearing end and means rotatably securing said bearing end to the carriage and positioned for engaging said moving edge, said lever and carriage being arranged so that said lever in response to engaging said moving edge initially displaces with said carriage in said given direction from a carriage start position without rotating and being so arranged so that said lever rotates from a first position to a second position in response to said engaging after said initial displacing; and switch means coupled to the carriage for sensing a given displacement position of said carriage during said initial displacement in said given direction regardless of said thickness.

3. The apparatus of claim 2 wherein said apparatus includes means for returning said carriage to said start position in response to the rotation of said lever to said second position.

4. The apparatus of claim 3 wherein said switch means includes means for continuously sensing the presence of said sheet material regardless the position of said carriage in said given direction after said initial displacing.

5. The apparatus of claim 4 wherein said switch means is coupled to said lever, said switch means for sensing the presence of the material while said lever is in the rotated second position and for sensing the absence of the material when the lever returns to said first position from the second position.

6. The apparatus of claim 2 wherein said switch means includes a Hall-element secured in fixed position relative to said carriage and a magnet secured to said lever.

7. The apparatus of claim 6 wherein said switch means has first and second switch states, said switch means being so arranged such that the switch means does not change state when the lever is in said second position and said carriage is displaced to said start position from the carriage displaced position.

8. Apparatus for position indicating a leading edge of sheet material moving in a path in a given direction with a rotatable lever, said lever tending to rotate through different angular extents in response to said moving edge in accordance with the thickness of said material, said apparatus comprising:

a carriage slideably secured for displacement in directions parallel to said given direction;

first spring means for resiliently urging the carriage in a direction opposite said given direction;

a lever having a bearing end and means rotatably securing said bearing end to the carriage and positioned in said path for rotating in a first direction in response to engaging said moving edge;

second spring means for resiliently urging the lever to rotate in a direction opposite said first direction, said first and second spring means being arranged so that said lever in response to engaging said moving edge initially displaces with said carriage in said given direction from a carriage start position without rotating and being so arranged so that said lever rotates from a first position to a second position in response to said engaging after said initial displacing; and a sensor comprising a magnetically operated switch means coupled to the lever for sensing a given displacement position of said carriage during said initial displacement in said given direction regardless said thickness.

9. The apparatus of claim 8 wherein said lever is oriented normal to said given direction.

10. The apparatus of claim 1 wherein said means rotatably securing includes journal means fixedly secured to the carriage.

11. The apparatus as claimed in claim 10 further including a housing, one of said two guide plates and said sensor being secured to the housing, said housing having elongated slots forming said stop positions, said carriage including means engaging said slots for guiding the carriage.

12. The apparatus according to any one of claims 1, 9, 10 or 11 wherein said sensor comprises a Hall-element, said arrangement including a permanent magnet secured to the lever at the lever bearing end, said lever and sensor being arranged such that the magnetic field of the magnet is coupled to said element only when the lever is in a given angular orientation about said bearing end in said start position.

13. The apparatus of claim 12 wherein said guide plates have aligned openings, said lever projecting from said bearing end through said openings and said space.

14. The apparatus of claim 13 wherein said lever includes a hinged portion, said portion being hinged for rotation in a direction opposite said transport direction.

15. The apparatus of claim 14 wherein said arrangement of the lever and sensor includes positioning said bearing end from said space a distance such that the lever has a length sufficient to produce said given angular orientation.

* * * * *